United States Patent [19]

Zennedjian

[11] Patent Number: 4,750,282

[45] Date of Patent: Jun. 14, 1988

[54] FRONT LOADING PICTURE FRAME

[75] Inventor: Garbis Zennedjian, Bloomfield Hills, Mich.

[73] Assignee: GMB Galerie Internationale, Royal Oak, Mich.

[21] Appl. No.: 878,190

[22] Filed: Jun. 25, 1986

[51] Int. Cl.[4] ..... G09F 1/12

[52] U.S. Cl. ..... 40/152; 40/611

[58] Field of Search ..... 40/152, 152.1, 611

[56] References Cited

U.S. PATENT DOCUMENTS

| | | | |
|---|---|---|---|
| 231,473 | 8/1880 | Brower | 40/152 |
| 272,036 | 2/1883 | Fassitt | 40/152 |
| 696,502 | 4/1902 | Seebach | 40/152 |
| 907,648 | 12/1908 | Stottum | 40/152 |
| 1,587,443 | 6/1926 | Terwilliger | 40/152 |
| 1,649,415 | 11/1927 | Moseson | 40/152 |
| 1,812,403 | 6/1931 | Hummer | 40/152 |
| 3,731,413 | 5/1973 | Hooper | 40/152 |

FOREIGN PATENT DOCUMENTS

| | | | |
|---|---|---|---|
| 23282 | of 1895 | United Kingdom | 40/152 |

*Primary Examiner*—Henry E. Raduazo

*Attorney, Agent, or Firm*—Gifford, Groh, VanOphem, Sheridan, Sprinkle and Dolgorukov

[57] ABSTRACT

A front loading picture frame made of joined lengths of flanged molding forming the perimeter of a window opening. A face plate and a back plate are urged apart and against opposing inside surfaces of the molding flanges by a spring. By exerting pressure on the face plate, the spring is compressed thereby allowing movement of the face plate away from the inside surface of the front flange of the molding. A picture or other document having a perimeter greater than that of the window opening is inserted in the window opening with its marginal areas into the space between the face plate and the inside surface of the molding flange. When pressure is removed from the picture, the spring gently urges the face plate forward to retain the edges and marginal areas of the picture under the front flange of the molding.

6 Claims, 2 Drawing Sheets

FRONT LOADING PICTURE FRAME

BACKGROUND OF THE INVENTION

The present invention relates to picture frames in general and more particularly to picture frames adapted to be loaded from the front of the frame rather than from the back of the frame.

Diverse framing structures are known for displaying paintings, pictures, photographs, diplomas, licenses, or the like. Such structures generally consist of a metallic, wooden or plastic molding surrounding a window opening sometimes provided with a pane of glass or transparent plastic, which include a back plate which may be either non-removable, hinged or fully removable. Most common is a back plate whose perimeter dimensions correspond to the inner perimeter dimensions of the rear of the frame molding. The back plate is secured to the frame molding by means of a plurality of either removable, rotatable, or bendable tabs, or pins, staples or the like. The steps for installing a picture or a document require either removing the pins or staples, or rotating or bending the tabs, as may be the case, in order to free the back plate, then opening the back plate, inserting the picture or document so that it faces the front of the frame and appears through the window opening, reinstalling the back plate, and fastening it in position by reinserting the pins or staples, or rotating or bending the tabs, thereby enclose the picture or document within the frame between the back plate and the frame window.

Such a sequence of steps is time consuming, may require the use of various tools to facilitate manipulation of the tabs or insertion of the pins or staples, and often requires repeating the entire process if it is found that the picture or document, once framed, is not properly centered.

SUMMARY OF THE INVENTION

The present invention relates to picture frames and more particularly to a frame which allows insertion of a picture or document, or the like, from the front face, thereby eliminating either partial or complete disassembly of the back plate of the frame structure. The present invention allows adjustments in the location and centering of the picture or document being displayed, as required, without disassembly of the frame back plate. A picture frame according to the present invention is particularly useful for displaying documents such as licenses, which are reissued or renewed on a periodic basis, requiring removal of the expired license from the frame and installing a new one in the frame. The entire process of exchanging documents can be done with ease and rapidly, and even while the frame remains attached on a wall.

These and other advantages and objects of the present invention will become apparent to those skilled in the art when the following description of the best mode, contemplated at the present, for practicing the invention is read in conjunction with the accompanying drawing, in which:

DETAILED DESCRIPTION OF THE PREFERRED EMBODIMENT

Figure 1:
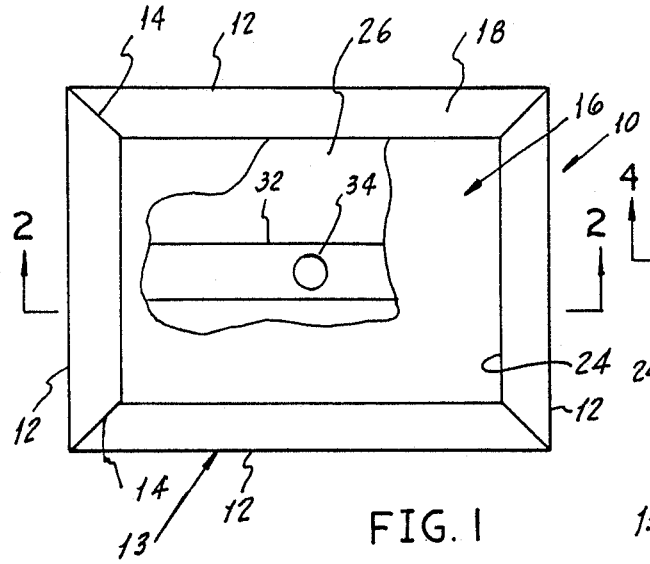
FIG. 1 is a front plan view of a picture frame according to the present invention, with a portion broken away to show the internal structure.

The present invention consists of a picture frame 10, shown at FIGS. 1–10 to be of rectangular shape and which consists of four linear lengths 12 of molding, generally designated as 13, defining a closed perimeter framing member. The molding lengths 12 are mitred at their ends and joined to each other, as shown at 14, by any one of a variety of methods such as by glueing, or by L-shaped joining plates or brackets, not shown, such as to form a substantially rectangular frame configuration surrounding an opening or window 16. As shown at FIGS. 2, 4, 6, 7 and 10, the frame molding 13 which may be made of metal, wood, or plastic, has a generally C-shaped configuration in cross-section defining a front flange 18 and a rear flange 20 joined by an integral sidewall 21. A face plate 22 is disposed behind the window opening 16. The face plate 22 has a perimeter larger than the window opening 16 such as to marginally project beyond the inner edge 24 of the molding front flange 18. The face plate 22 consists of a sheet of relatively rigid material such as, for example, a cardboard sheet having a thickness of ⅛ inch (3 mm) or more. A back plate 26 having substantially the same dimensions and consisting of substantiaailly the same material as the face plate 22 is disposed behind the face plate 22 such that its perimeter edge projects beyond the edge 30 of the frame molding rear flange 20. A spring member in the form of a bowed leaf spring 32, as shown at FIGS. 2, 4, 6, 7 and 10, is disposed between the face plate 22 and the back plate 26 and is secured to approximately the middle of the rear plate 26 by conventional means, well known in the art, such as a screw or a rivet 34. The bowed leaf spring 32 gently urges the marginal area of the face plate 22 into engagement with the inside surface of the molding front flange 18 and the marginal area of the back plate 26 into engagement with the inside surface of the molding rear flange 20. It will be appreciated that the spring member 32 may be of a different design such as a coil spring, or that two or more leaf springs may be used, and that the back plate 26 with the spring member 32 attached thereto and the face plate 22 are inserted within the frame 10 prior to completing the assembly of the frame by fastening the fourth lengths 12 of molding 13.

Figure 3:
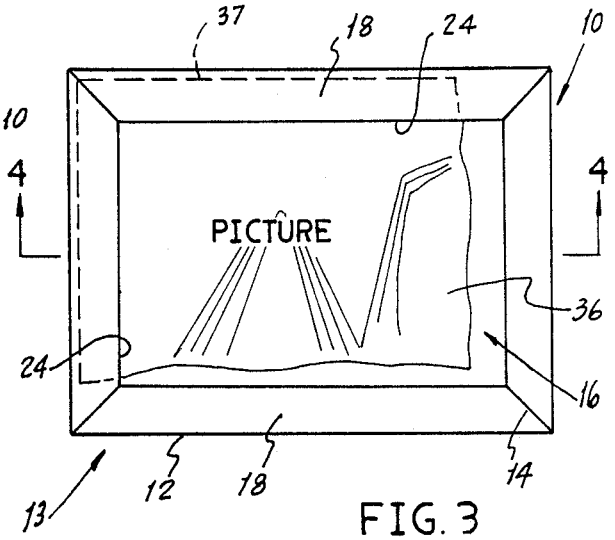
FIG. 3 is a frontal plan view of the picture frame of FIG. 1 showing insertion therein of a flexible sheet such as a picture or document.
Figure 2:
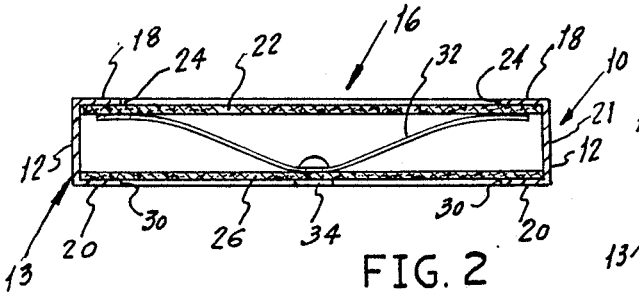
FIG. 2 is a sectional view along line 2—2 of FIG. 1.
Figure 4:
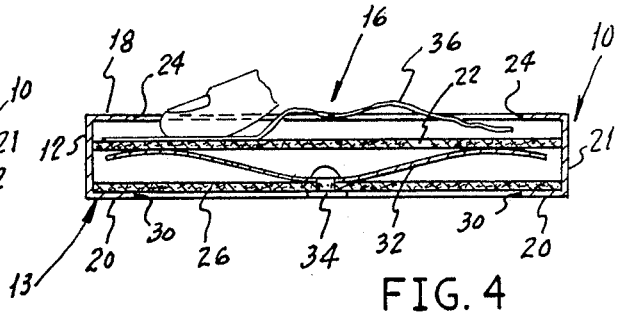
FIG. 4 is a sectional view along line 4—4 of FIG. 3.
Figure 5:
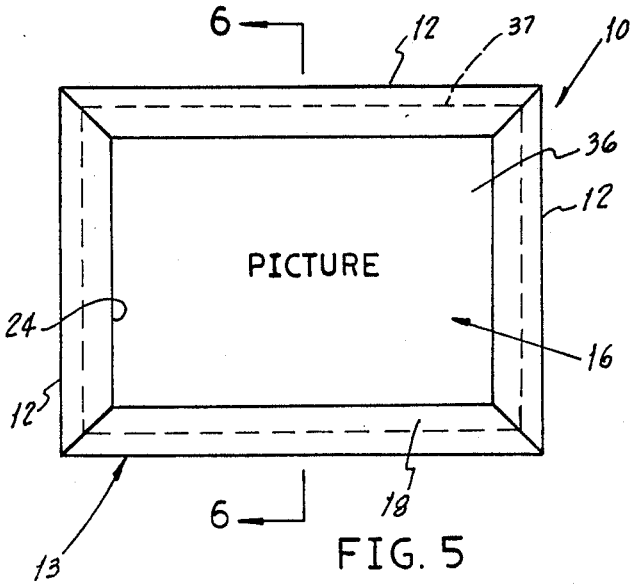
FIG. 5 is a front plan view of the picture frame showing the fully installed flexible sheet picture or document.
Figure 6:
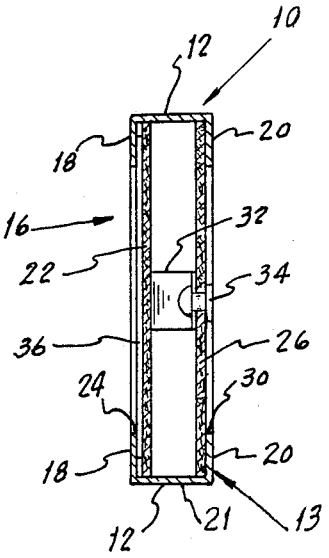
FIG. 6 is a sectional view along line 6—6 of FIG. 5.

The procedure for installing a flexible sheet picture or document 36 in the picture frame 10 consists in placing the flexible sheet 36 into the face plate 22 through the window opening 16, as best shown at FIGS. 3 and 4, gently pushing the flexible sheet 36 and face plate 22 toward the rear plate 26, thereby compressing the bowed leaf spring 32. This step opens up a space between the marginal areas of the face plate 22 and the inside surface of the front flange 18 of the molding 13. The flexible sheet 36 is then gently inserted into one of the four corners, as shown at FIGS. 3 and 4, and is urged to seat under the molding front flange 18. This is best shown by the broken line 37 at FIG. 3. Once the flexible sheet 36 is seated in one corner, it is gently flexed and urged to seat in the remaining three corners. FIGS. 5 and 6 show the flexible sheet 36 in its fully installed position held in place between the inside surface of the molding front flange 18 and the face plate 22 by the force of the bowed leaf spring 32 urging the face plate 22 toward the inside surface of the molding front flange 18. To help protect the flexible sheet 36 from damage or contamination from the environment, it may be encapsulated or laminated, if desired, in a clear plastic film which allows the flexible sheet 36 to maintain substantially the same flexibility characteristics and provide the same ease in installation.

Figure 7:
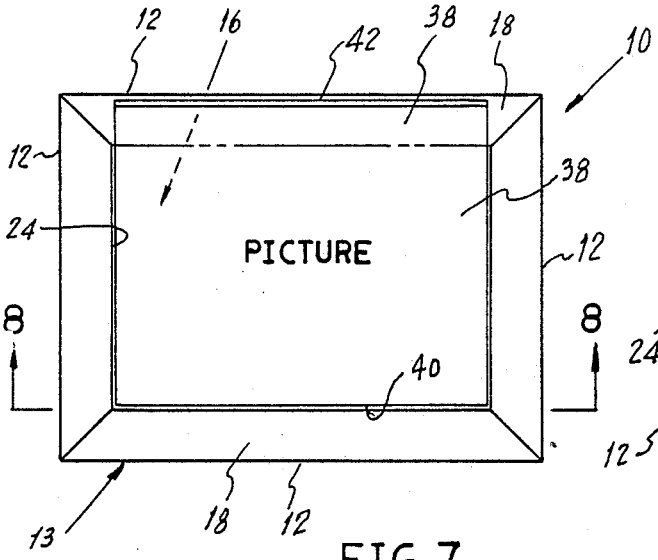
FIG. 7 is a front plan view of the picture frame of the invention showing the first step in installing a rigid sheet therein.
Figure 9:
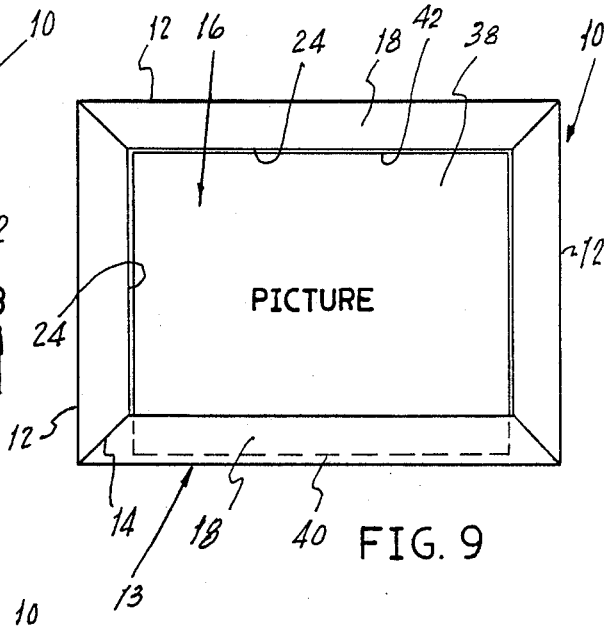
FIGS. 9 and 10 are views similar to FIG. 7, but showing subsequent steps in installing a rigid sheet in the picture frame of the invention.
Figure 8:
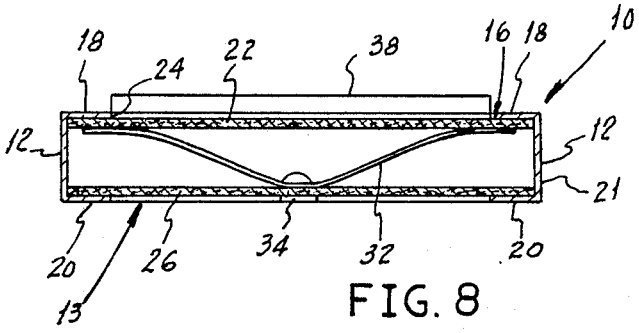
FIG. 8 is a section along line 8—8 of FIG. 7.
Figure 10:
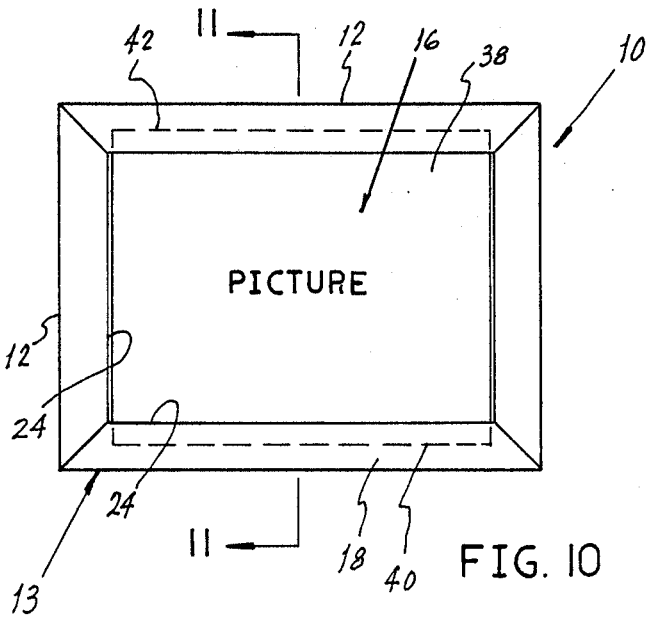
Figure 11:
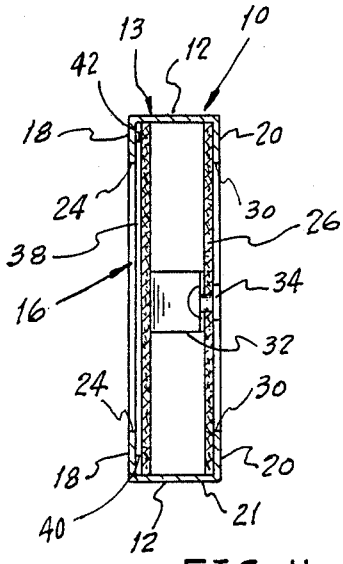
FIG. 11 is a sectional view along line 11—11 of FIG. 10.

The picture frame 10 can also be used to mount and display inherently relatively rigid pictures or documents, such as those that are matted, or to enable rigid protective covers such as glass, plexiglass, or transparent plastic to be installed over a flexible sheet, picture or document. FIGS. 7–11 illustrate a sequence of steps for installing a rigid sheet, picture or document or a rigid transparent cover over a flexible sheet, picture or document already inserted in the frame 10 of the invention, the rigid sheet being generally designated at 38. Unless one of the lengths 12 of molding 13 forming one side of the picture frame 10 is made removable, the rigid sheet 38 must be cut to a width or to a height dimension permitting two opposite edges of the sheet 38 to fit within opposite edges 24 of the window opening 16. The distance between the two other opposite edges of the rigid sheet 38 is left longer than the distance between the two other opposite edges 24 of the window opening 16. As shown at FIG. 7, the rigid sheet 38 is placed over the window opening 16 such that, for example, its lateral edges fit within the lateral edges 24 of the window opening 16 and one edge, the lower edge as shown in the drawing, abuts against the lower edge 24 of the window opening 16. By applying pressure upon the rigid sheet 38 proximate its lower edge, the frame front plate 22 is slightly deflected against the tension of the spring 32, such as to allow the lower longitudinal edge 40 of the rigid sheet 38 to be pushed below the inner surface of the corresponding molding front flange 18, to a position, as shown at FIG. 9, enabling the upper edge 42 of the rigid sheet 38 to be positioned beyond the corresponding edge 24 of the upper, as oriented in the drawing, length 12 of molding 13. Pressure is then applied to the face of the rigid sheet 38, such as to depress the front plate 22 sufficiently to permit slipping the upper edge 42 of the rigid sheet 38 below and beyond the edge 24 of the upper length 12 of molding 13, such as to hold the rigid sheet 38 in the frame 10 as schematically illustrated at FIGS. 10–11.

It will be appreciated by those skilled in the art that the picture frame 10 may be of a shape other than the rectangular shape illustrated. For example, a picture frame according to the present invention may be oval-shaped or circularly shaped without departing from the spirit and scope of the invention.

The ease with which a picture or other document may be inserted into the picture frame 10 is due to the fact that the picture or document being displayed in the frame is installed through the front face window opening of the frame without having to open the frame. This results in a picture mounting operation which is less complex and less time consuming than that required by conventional picture frames.

Having thus described the present invention by way of an example of structure well designed to achieve the objects of the invention, modifications whereof will be apparent to those skilled in the art, what is claimed as new is as follows:

1. A front loading picture frame comprising:

a closed, parallelogram-shaped perimeter framing member having a flange defining a window opening;

a rigid back plate secured to said framing member spaced apart from said flange;

a rigid face plate disposed in said framing member between said back plate and said flange, siad face plate having a marginal area exceeding the area of the window opening of said flange;

a front-removable protective transparent cover placeable over a sheet displayed within said window opening; and spring means disposed between said back plate and said face plate for urging the marginal area of said face plate into a first position in engagement with said flange, and said spring means is sufficiently resilient to allow said face plate to be depressed away from said flange to a second position between said flange and said back plate.

2. The front loading picture frame of claim 1 wherein said spring means comprises a leaf spring disposed between said back plate and said front plate.

3. The front loading picture frame of claim 2 wherein said leaf spring is secured to said back plate.

4. A front loading closed picture frame comprising:

a molding having a front flange spaced from a rear flange and forming a closed perimeter, said front flange being formed from at least two opposed front flange portions defining a window opening between them, said flanges being directed inwardly;

a rigid face plate and a rigid back plate, said plates being dimensioned to be retained within said molding between said front flange and said rear flange;

spring means disposed between said face plate and said back plate for urging said plates to a first spaced apart parallel position in which each plate is in engagement with a corresponding flange, said spring means being sufficiently resilient to allow said face plate to be reversibly depressed away from said front flange to a second position within the interior of said molding; and a planar display object dimensioned to be abuttably retained between said rigid face place and said at least two opposed portions of said front flange, but removable therefrom through said window opening.

5. The front loading picture frame of claim 4 wherein said spring means comprises a leaf spring.

6. The front loading picture frame of claim 5 wherein said leaf spring is secured to said back plate.

* * * * *